United States Patent [19]

Hase

[11] 4,142,141

[45] Feb. 27, 1979

[54] FERRORESONANT VOLTAGE REGULATING CIRCUIT

[76] Inventor: Alfred M. Hase, 6 Manorwood Rd., Scarborough, Ontario, Canada

[21] Appl. No.: 768,590

[22] Filed: Feb. 14, 1977

Related U.S. Application Data

[63] Continuation-in-part of Ser. No. 612,869, Sep. 12, 1975, abandoned.

[51] Int. Cl.[2] ..... G05F 1/38

[52] U.S. Cl. ..... 323/6; 323/60

[58] Field of Search ..... 323/6, 44 R, 60, 61

[56] References Cited

U.S. PATENT DOCUMENTS

| | | | |
|---|---|---|---|
| 2,806,199 | 9/1957 | Sola | 323/60 |
| 3,573,606 | 4/1971 | Hart et al. | 323/60 |
| 3,824,449 | 7/1974 | Hase | 323/6 |
| 3,889,176 | 6/1975 | Randall | 323/60 X |
| 3,914,685 | 10/1975 | Gilder | 323/60 X |
| 3,988,662 | 10/1976 | Hunter | 323/60 X |
| 4,001,665 | 1/1977 | Wisner et al. | 323/60 X |

OTHER PUBLICATIONS

Williams, "Magnetic Voltage Regulator", IBMTDB, vol. 16, No. 10, Mar. 1974, pp. 3132, 3133.

*Primary Examiner*—A. D. Pellinen
*Attorney, Agent, or Firm*—Donald E. Hewson

[57] ABSTRACT

A ferroresonant voltage regulator circuit includes a non-saturating transformer, a linear reactor in series with the input, and a capacitor across the non-saturating transformer. Voltage sensing and referencing circuits are inserted in the output. A synchronous switch — usually a saturable reactor, a magnetic amplifier, a triac or back-to-back SCR's — is connected in shunt across at least a portion of the non-saturating transformer, and is controlled by its control coil in a manner such that the non-saturating transformer is loaded by the shunt loop at no-load conditions of the regulator. The control coil of the synchronous switch is connected in the voltage sensing and referencing circuits, and acts so that the amount of loading on the non-saturating transformer from the synchronous switch varies substantially inversely as the amount of loading because of the load on the voltage regulator circuit. A linear reactor may be series connected with the synchronous switch in the shunt loop. The non-saturating transformer has an air gap in its iron core so that it has a considerably more linear volt-ampere vs. flux density characteristic of the core and the air gap than that of a similarly rated and constructed saturating transformer.

6 Claims, 11 Drawing Figures

FERRORESONANT VOLTAGE REGULATING CIRCUIT

CROSS REFERENCE TO OTHER APPLICATIONS

This application is a continuation-in-part application of prior application Ser. No. 612,869 filed Sept. 12, 1975 in the name of the present inventor, which prior application is now abandoned.

FIELD OF THE INVENTION

This invention relates to a voltage regulating circuit, particularly a ferroresonant AC voltage regulator. The invention provides an AC voltage regulator which can be built to have relatively high KVA ratings; and provides an improvement over my prior U.S. Pat. No. 3,824,449 issued July 16, 1974.

BACKGROUND OF THE INVENTION

Ferroresonant voltage regulators having saturable and unsaturable transformers are known, where the ferroresonant circuit comprises a saturable transformer — usually an autotransformer — an unsaturable transformer or an unsaturable reactor or linear reactor in series with the saturable transformer and the voltage source, and a capacitor across one of the windings of the saturable transformer so as to cause a ferroresonant circuit which is tuned to the line frequency or the fundamental frequency of the output voltage from the voltage regulator. It has been a major source of concern to reduce the size and weight of ferroresonant voltage regulators, and hence the cost thereof. Balian et al U.S. Pat. No. 3,611,116 issued Oct. 5, 1971 teaches a circuit where one of the secondaries of an unsaturable transformer is connected in series-aiding with one of the windings of a saturable transformer or autotransformer, and is inclined directly in the ferroresonant circuit. The capacitor, in this case, is connected across the series connection of the secondary winding to form the ferroresonant circuit.

Other ferroresonant circuits, such as that taught in Gorbuntsov et al U.S. Pat. No. 3,662,254, issued May 9, 1972, include ferroresonant circuits where the saturable transformer winding is in series with a linear choke, but where the compensating winding is connected in series with an output circuit and capacitor. In the Gorbuntsov et al circuit, an additional compensating winding is provided in series with the capacitor to compensate variations of voltage in the capacitor circuit, resulting in a stabilized AC output. However, the output of such circuit — while well stabilized — may have very poor waveform — and in any event, such output would normally be intended to be rectified to a constant voltage DC.

Thus, there are certain disadvantages which are generally found in ferroresonant circuits in AC voltage regulators; and they include the fact that the basic ferroresonant circuit yields a distorted output waveform which may be flat or dented at no-load conditions, becoming sinusoidal at full load conditions. Other disadvantages of ferroresonant circuits that have been used in the past are the fact that frequency variation and voltage changes which are caused by changes of the load and changes in ambient temperature, cannot be compensated for and may be reflected in the output voltage. Also, because prior art ferroresonant circuits operate in the high magnetizing region of the transformer core, such circuits are normally limited to relatively low KVA power ratings because of the extra heat losses which are generated in the saturable transformer and other circuit components.

On the other hand, there are certain inherent advantages in the use of ferroresonant circuits in AC voltage regulators, and they include the fact that a basic ferroresonant circuit can maintain good voltage regulation — at least within name plate ratings — for line voltage variations of plus or minus 15%. Ferroresonant circuits generally have a fast response time, in the order of less than a few periods of the line frequency; and they normally have very low overshoot or undershoot. Because of their nature, ferroresonant circuits have inherent current limiting and a short circuit-proof overload characteristic, and having high efficiency and inherent reliability.

As noted, however, constant voltage regulation in a basic ferroresonant circuit is achieved because it includes a saturable transformer which is designed and driven to operate in the high, saturating part of its hysteresis curve; and of course, the saturable transformer has a grain oriented steel core and may be generally referred to as a transformer having an iron core. Because the saturable transformer is designed to operate in the high saturating part of its hysteresis curve, the transformer is generally limited to low KVA power ratings because of extra heat losses which may occur.

The present invention maintains the advantages of prior, basic ferroresonant circuits including those of my prior ferroresonant circuit in the patent noted above, and provides a ferroresonant voltage regulating circuit having a basic tuned ferroresonant circuit with a synchronous switch such as a saturable reactor having a control coil, with the synchronous switch connected in shunt across at least a portion of a winding of an iron core, non-saturating transformer havng an air gap in its core. The control coil of the synchronous switch is connected in series with a three-wire semiconductor device which is connected together with suitable voltage sensing and reference circuits in the output of the voltage regulator so as to drive the synchronous switch to conductive state at no-load conditions of the voltage regulator, thereby preloading the non-saturating transformer and the basic ferroresonant circuit.

I have discovered that if the saturating transformer previously used in my earlier patent, noted above, is replaced with a transformer having an iron core with an air gap, equally good voltage regulation can be obtained — within one percent, depending on the sensing circuits used — while at the same time waveform distortion can be held to within one to three percent total harmonic content without the use of any additional linear reactor in the output of the ferroresonant circuit.

What is meant by a non-saturating transformer in this context is a transformer having a laminated iron core, and where the core has an air gap. The volt-ampere vs. flux density characteristic of the core and air gap of such a transformer is considerably more apparently linear than that of the core of a similarly rated and constructed saturating transformer.

By providing control of the synchronous switch which is across the non-saturating transformer, regulating AC output having closely regulated voltage and low waveform distortion can be accomplished, making the AC voltage regulator of the present invention particularly well suited for use as an AC-filter and/or waveform regulator for inverter applications.

By providing for the use of discreet components in basic ferroresonant circuit, and also for the shunt loop which basically comprises the synchronous switch, an excellent harmonic and r.f. rejection mode of a ferroresonant voltage regulator according to this invention may be achieved. Thus, the regulator may be utilized to provide a low harmonic, sinusoidal, and r.f. — free regulated output notwithstanding the shape of the waveform or r.f. constituent of the input to the regulating circuit.

I have also discovered that certain other circuit improvements may be made to further decrease the harmonic content of the output voltage waveform and/or to further increase the response time of the ferroresonant voltage regulating circuit to changes in load conditions, where such circuit additions and improvements comprise the series connection of an additional linear reactor or cross-connected transformer with the synchronous switch so that the series connection is connected in shunt across at least a portion of a winding of the non-saturating, constant voltage transformer.

BRIEF SUMMARY OF THE INVENTION

It is a purpose of this invention to provide a ferroresonant voltage regulator having a basic ferroresonant circuit with a non-saturating transformer which is preloaded by a synchronous switch which, in turn, is driven by reference to the output voltage of the voltage regulator.

An object of this invention is to provide a ferroresonant voltage regulator which can be operated at relatively high KVA power ratings.

A feature of this invention is that the basic ferroresonant and the feedback voltage regulating circuit taught hereby can be relatively inexpensively produced using essentially "off-the-shelf" circuit elements.

DESCRIPTION OF THE DRAWINGS

These and other purposes, objects and features of the invention are more fully discussed hereafter in association with the accompanying drawings, in which.

DESCRIPTION OF THE PREFERRED EMBODIMENTS

Figure 1:
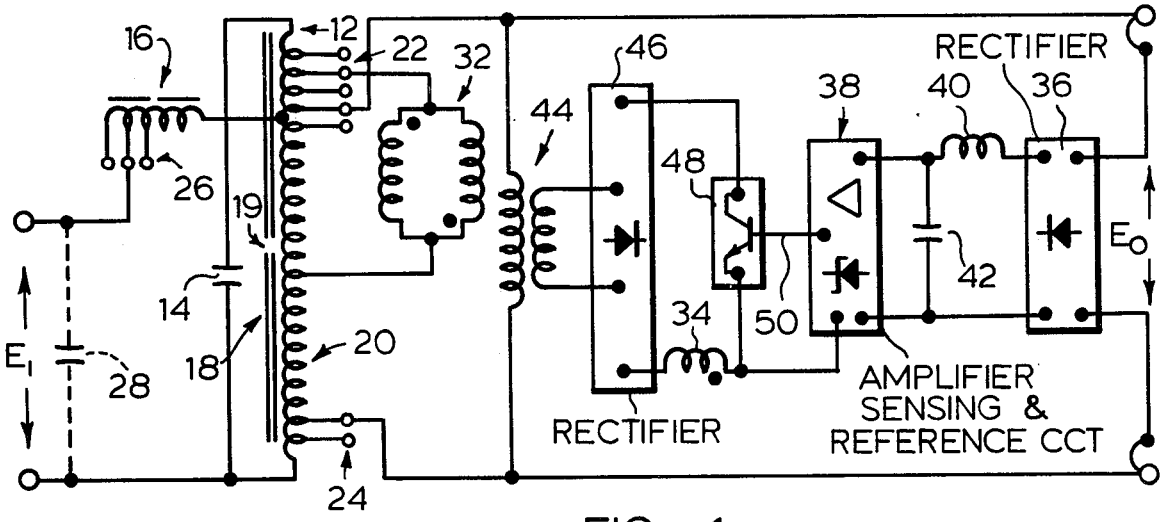
FIG. 1 is a basic circuit showing a ferroresonant voltage regulator in accordance with this invention.
Figure 9:
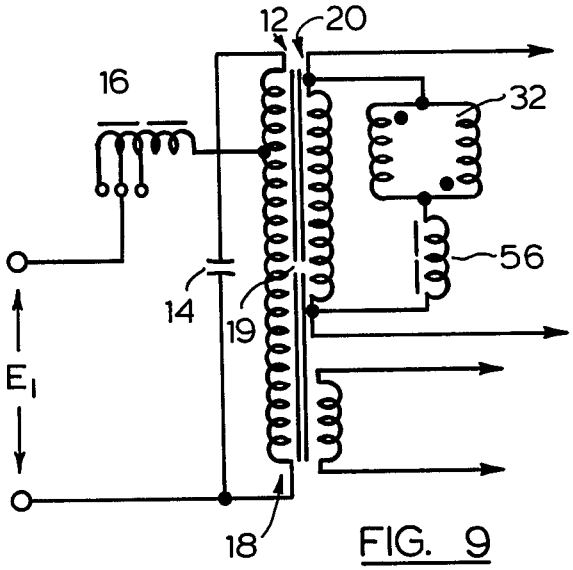
FIG. 9 is an alternative representation of another portion of the circuits of FIGS. 1, 3, 4 5.

The present invention provides a ferroresonant voltage regulating circuit having an AC input voltage $E_I$ and a regulated AC output voltage $E_O$. The ferroresonant voltage regulating circuit of the present invention includes a basic, tuned ferroresonant circuit which is tuned for optimum voltage regulating performance at the fundamental frequency of the output voltage $E_O$. The basic ferroresonant circuit, as shown in FIG. 1, comprises a non-saturating constant voltage transformer indicated generally at 12, having an iron core; a capacitor 14 which is connected across the constant voltage transformer; and a linear reactor 16 which has an air gap and which is connected in series with the input voltage $E_I$. The constant voltage transformer — which is, as noted above, a non-saturating transformer — has an input side indicated generally at 18 and an output side indicated generally at 20. The constant voltage transformer 12 may be an autotransformer; or it may be an isolating transformer as shown in FIG. 9. In any event, the capacitor 14 is connected across the constant voltage transformer 12 so as to be across either the input side 18 of the transformer or the output side 20 of the transformer. When the constant voltage transformer 12 is an autotransformer the linear reactor 16 is connected to a suitable input tap as required and as determined by the line voltage conditions. The capacitor 14 is connected across the autotransformer — and normally the capacitor 14 is connected to a higher tap than any other input tap which is used. The output tap on the autotransformer is chosen for the required value of $E_O$.

If the constant voltage transformer 12 is an isolating transformer as in FIG. 9, the input voltage $E_I$ is across the primary of the isolating transformer, and the output voltage $E_O$ is taken from across the secondary of the transformer. The linear reactor 16 may be connected in series with the input voltage $E_I$ to either the primary or the secondary winding of the isolating transformer which is used as the constant voltage transformer 12; and the capacitor 14 may be connected across either the primary or secondary winding. In any event, the connection of the capacitor 14 and linear reactor 16 is made with the iron core isolating transformer so as to form a basic ferroresonant circuit, tuned to the fundamental frequency of the output voltage $E_O$.

It should be noted that the constant voltage transformer 12 is shown having a number of coarse taps indicated at 22, and a number of fine taps indicated at 24. The coarse and fine taps may be on the primary or secondary windings, or both, of an isolating transformer; or they may be as shown in FIG. 1 for an autotransformer. In addition, the linear reactor 16 may be tapped, as shown at 26. The linear reactor 16 has an air gap, which allows for current limiting of the regulated output power. It should be noted that, as is well known to persons skilled in the art, the constant voltage transformer 12 includes an overwind coil which allows optimum tuning of the basic ferroresonant circuit. The overwind coil is wound on the same coil of the constant voltage transformer that the capacitor 14 is connected across.

A synchronous switch is connected across at least a portion of a winding of the constant voltage transformer 12, as shown generally at 32 in FIG. 1, and may be an ampere turns device such as a saturable core reactor or a magnetic amplifier; or it may be equivalent, suitably filtered, back-to-back silicon rectifiers or triacs. In any event, the synchronous switch has a control coil or gating circuit 34 which is arranged so as to make the synchronous switch conductive when the control coil or circuit is conductive. The circuit conditions relating to the control coil are discussed hereafter.

It has been noted that the synchronous switch is connected across at least a portion of a winding of the non-saturating constant voltage transformer 12. When the constant voltage transformer is an autotransformer, the connection of the synchronous switch may be as shown in FIG. 1; and when the non-saturating transformer is an isolating transformer, the synchronous switch may be connected across at least a portion of either the primary or secondary winding, such as is shown in FIG. 9. The purpose of the synchronous switch 32 is to keep a load on the core of the non-saturating constant voltage transformer, under the control of the conditions of the output voltage $E_O$ under any load condition. Thus, minimum waveform distortion of the voltage waveform at the output terminals of the regulating circuit according to this invention may be achieved. The synchronous switch 32 acts as a preload on the core of the saturable or constant voltage transformer 12.

It should be noted that the core of the non-saturating constant voltage transformer 12 is shown to be an iron core of the non-saturating type; and usually has one or more specific air gaps formed therein.

By having the preload synchronous switch or reactor across either a portion or the entire winding of the non-saturating constant voltage transformer which forms a portion of the tuned ferroresonant circuit, the inherent fast response time of a basic ferroresonant circuit is preserved at all load conditions of the voltage regulator according to this invention. This is because the preload reactor is always biased with a constant voltage — because of the constant voltage operation of the tuned basic ferroresonant circuit — so that only the current must change in the preload reactor or synchronous switch as load conditions on the voltage regulator change. Because only the current must change under the constant voltage bias, fast response — within a few cycles of the output frequency — is assured.

The remainder of the voltage regulator circuit according to this invention comprises voltage sensing means across the output of the voltage regulating circuit, and a DC bridge, suitable amplifiers if required and reference circuit means connected to the voltage sensing means in driving relationshop with a three-wire semiconductor device so as to render the three-wire semiconductor device conductive at no-load conditions of the voltage regulating circuit according to this invention. As well, the circuit comprises a DC voltage supply for the three-wire semiconductor device. Referring to the circuit of FIG. 1, for example, a rectifier 36 is shown connected across the output of the voltage regulating circuit. Suitable amplifier, sensing and reference circuit means of the sort known to the skilled practitioner may be included in a circuit element marked generally at 38, which is fed from the rectifier 36. A choke 40 and a capacitor 42 may be inserted between the DC bridge 36 and the circuits 38, for purposes discussed hereafter.

An auxiliary DC power supply is also provided, such as by transformer 44 and rectifier bridge 46; and a three-wire semiconductor device 48 is connected to the DC voltage supply so as to be properly biased thereby. The three-wire semiconductor device 48 may be a transistor, in which case the connection 50 from it to circuits 38 is from the base of the transistor; or the three-wire semiconductor device may be an SCR, in which case the connection 50 to circuits 38 is from the gate of the SCR. The remaining connection of the three-wire semiconductor device to circuits 38 is through suitable isolating or equalization circuits, as well known to the skilled practitioner.

In any event, it will be noted that the three-wire semiconductor device 48 is connected with respect to the control coil 34 of the synchronous switch 32 so that the control coil 34 is in series with the three-wire semiconductor device 48. The sensing and voltage referencing circuitry 38 is arranged so that the three-wire semiconductor device 48 is conductive at no-load conditions of the voltage regulator circuit according to this invention; and thus at no-load conditions, the control coil 34 of the synchronous switch 32 is also conductive. Therefore at, no-load conditions the synchronous switch 32 is conductive and a preload condition exists with respect to the tuned ferroresonant circuit including the non-saturating constant voltage transformer 12 and the linear reactor 16. As the load conditions on the voltage regulator circuit according to this invention increase, the operation of the synchronous switch 32 changes in view of its reaction to its control coil 34, which in turn is driven from the three-wire semiconductor device 48, thus tending to unload the basic ferroresonant circuit. Fast response time to changing load conditions can be achieved; and sinusoidal waveform of the output voltage can be maintained over the complete operating load range.

When the circuits 38 are connected through the choke 40 and capacitor 42 to the rectifier 36, voltage sensing of output voltage $E_O$ becomes average sensing. In that case, control of the synchronous switch 32 by its control coil 34 can be average-regulated rather than peak or RMS-regulated. Thus, better waveform and better voltage regulation can be achieved, together with better system stability, than from a basic ferroresonant circuit. The voltage regulator including the average sensing is less sensitive to commutating-type loads, or loads having changing power factors. As noted above, the preload on the basic ferroresonant circuit by the addition of the synchronous switch 32 is such as to permit the presupposition that the waveform of output voltage $E_O$ will be sinusoidal at all load conditions.

It should be noted that a closed loop feedback circuit is achieved; and that precision regulation of the output voltage $E_O$ by operation of the synchronous switch 32 when controlled by its control coil 34 which is within the closed loop feedback circuit, is possible. Also, it should be noted that remote sensing of the output voltage $E_O$ can be accommodated, so that precision regulation of output voltage at terminals which are physically removed from the ferroresonant circuits is possible.

Because the present invention utilizes feedback loop voltage control, the output voltage $E_O$ is maintained constant irrespective of frequency changes of the input voltage $E_I$.

It has been noted that when the synchronous switch 32 is made to respond to average load-voltage demand of the load, the ferroresonant tuned circuit is loaded uniformly and can therefore maintain a constant output voltage $E_O$ with substantially uniform peak/RMS or RMS/average relationships. In other words, there will be a very low harmonic content in the output voltage $E_O$.

It is an inherent characteristic of ferroresonant tuned circuits of the sort taught herein that the output voltage waveform of the non-saturating constant voltage transformer is substantially sinusoidal. When the ferroresonant tuned circuit is loaded uniformly in accordance with this invention, almost any waveform of input voltage — from square wave to sinusoidal — can be accommodated, with substantially sinusoidal output voltage waveform at least in the range of power output according to the name plate.

Figure 2:
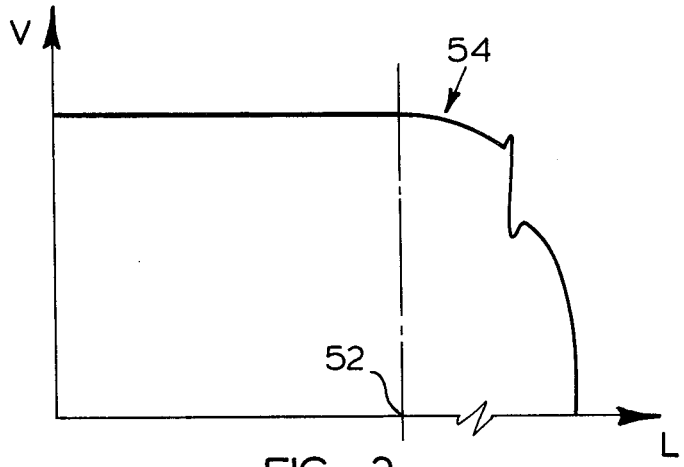
FIG. 2 is a curve showing typical voltage vs. load characteristics of a ferroresonant voltage regulator according to this invention.

FIG. 2 shows a typical curve of voltage vs. load of a voltage regulator according to this invention. Within name plate ratings of the regulator, to a limit marked at 52, the output voltage of the regulator is substantially constant. At some load higher than name plate ratings of the voltage regulator, the voltage begins to drop as at 54 because of the current limiting action of the linear reactor 16, which has an air gap; and ultimately the voltage drops to zero. Thus, there is an inherent short circuit proof operation of the circuit of FIG. 1. Under current-limiting and short circuit conditions, the input current to the basic ferroresonant circuit is affected by the linear reactor 16, and is highly inductive. Using power factor correcting means, such as capacitor 28 [or when the circuit is applied as an output regulator for inverters, and includes feedback diodes] the resultant input current can be reduced to less than 20% of the nominal full-load input current. In these conditions, the output voltage $E_O$ has collapsed substantially to zero.

In the event that the three-wire semiconductor device 48 should fail — whether it be a transistor or an SCR — the control coil 34 would be biased to its maximum conductivity because failure of a three-wire semiconductor device is by shorting, not by having the device become an open circuit. Thus, the circuit is "fail safe" and goes to low output in the event of the failure of the three-wire semiconductor device, because the synchronous switch 32 is driven to maximum load on the basic ferroresonant circuit.

Figure 3:
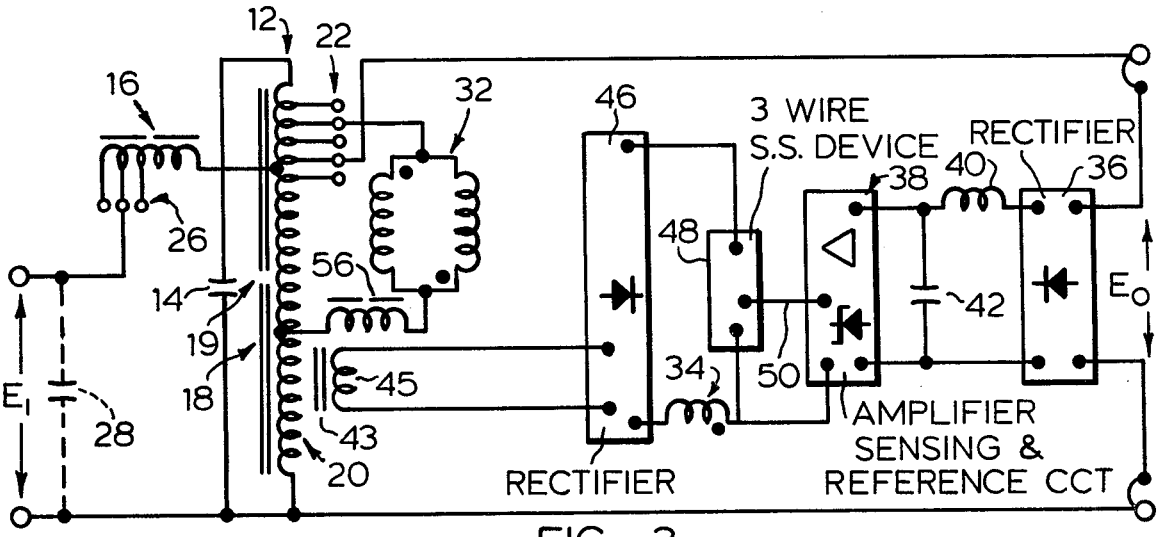
FIG. 3 is a circuit similar to that of FIG. 1, showing a first alternative embodiment.

Referring now to FIG. 3, an alternative arrangement of the basic circuit of FIG. 1 is shown. In this circuit, an additional linear reactor 56 is connected in series with the synchronous switch 32, so that the series connection of the synchronous switch 32 and linear reactor 56 is connected in shunt across the constant voltage transformer 12 in the same manner as discussed above. The circuit of FIG. 3 acts to assure that there is a low harmonic content in the output voltage waveform $E_O$, by precluding harmonic reflection passing the linear reactor 56.

Figure 4:
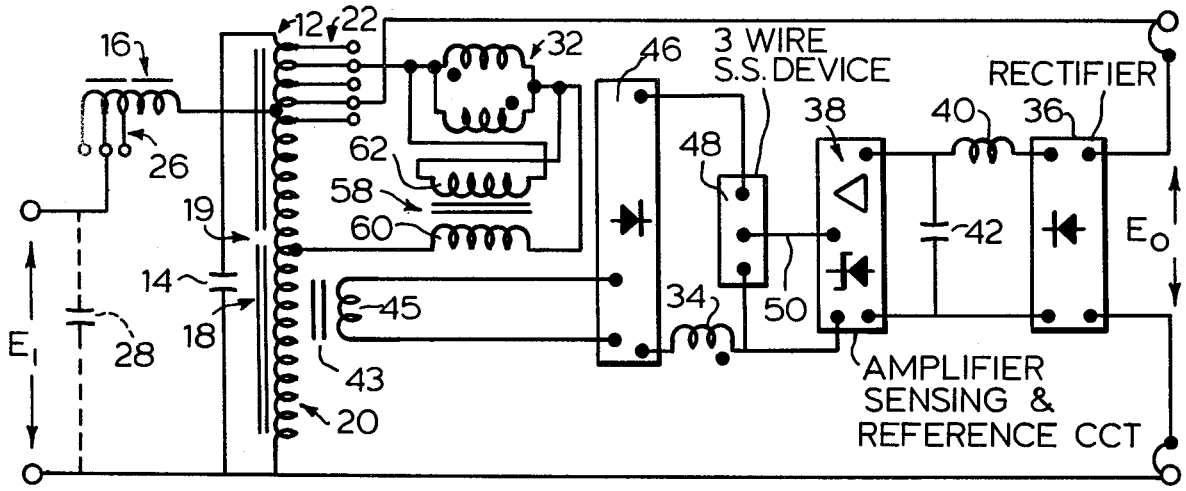
FIG. 4 is a circuit similar to that of FIG. 1, showing a second alternative embodiment.
Figure 11:
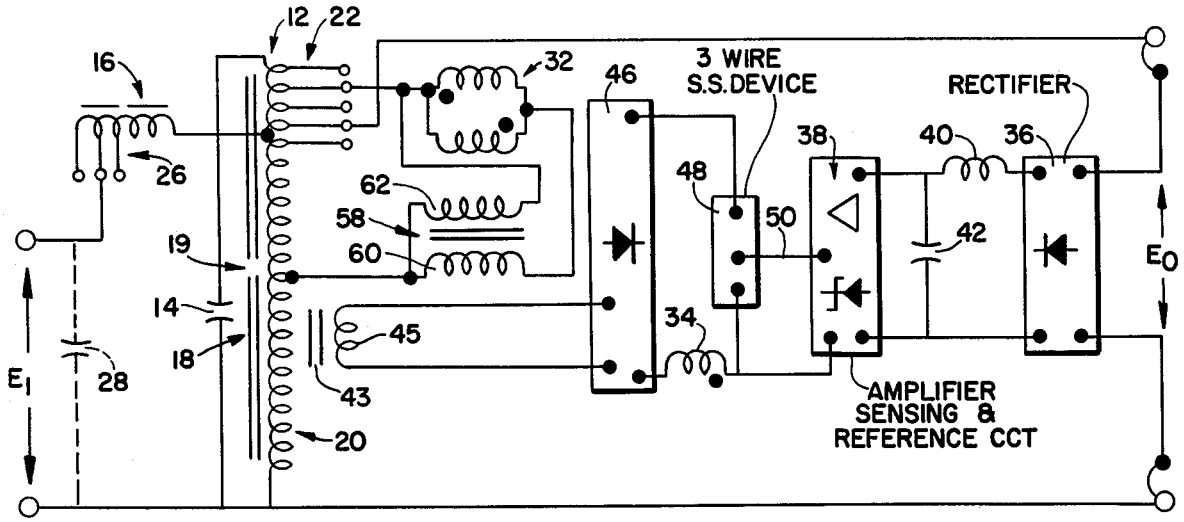
FIG. 11 is a circuit showing an alternative to that of FIG. 4.

Similarly, there is shown in FIG. 4 a second alternative embodiment to the basic circuit of FIG. 1, where the circuit of FIG. 4 not only provides that there is a low harmonic content in the output voltage waveform, but there is also a faster response to varying load conditions. In this circuit, the synchronous switch 32 is connected in series with the primary winding 60 of a transformer 58; and the secondary winding 62 of the transformer 58 is cross-connected across the synchronous switch 32. Alternatively, as shown in FIG. 11, the secondary winding 62 of the transformer 58 could be cross-connected across that portion of the winding of transformer 20 where the shunt loop is connected.

Figure 5:
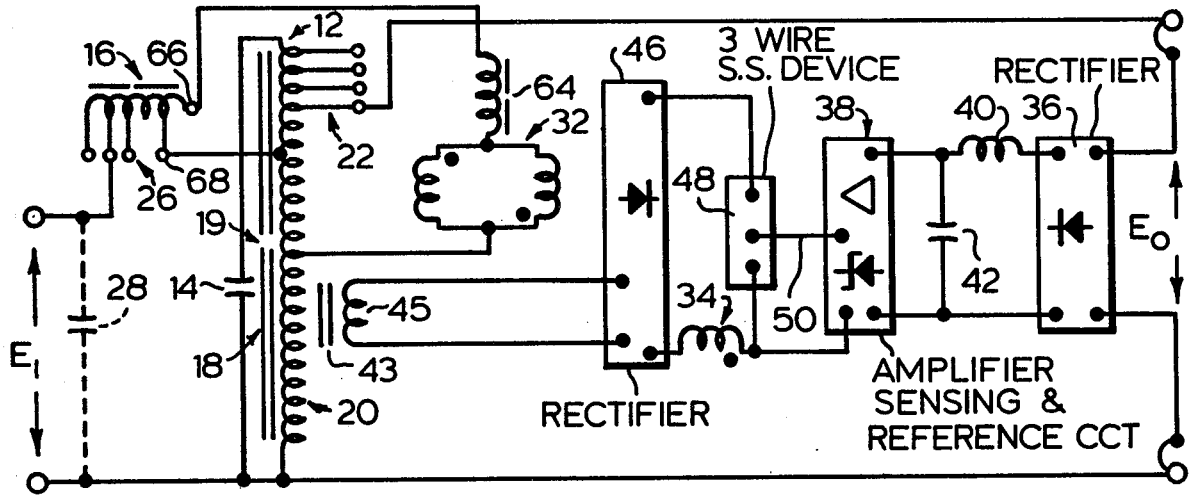
FIG. 5 is a circuit similar to that of FIG. 1, showing a third alternative embodiment.

Yet another alternative embodiment of the basic circuit of FIG. 1 is shown in FIG. 5. In this case, however, the synchronous switch 32 is connected in series with a further linear reactor 64 which, in turn, is connected in series with a tap 66 of the first linear reactor 16. The linear reactor 16 has another tap 68 which is connected to the constant voltage transfromer 12 so that the linear reactor 16 is connected in the tuned ferroresonant circuit comprising the linear reactor 16, capacitor 14 and transformer 12 through the tap 68. Either of taps 66 and 68 may be higher than the other tap 68 or 66, respectively. The connection of the series connection of synchronous switch 32 and linear reactor 64 to the transformer 12 is, therefore, through that portion of the linear reactor 16 between the taps 66 and 68.

FIG. 3 — as well as FIGS. 4 and 5 — shows an alternative arrangement for the auxiliary DC power supply, where an additional core 43 and winding 45 are provided in association with transformer 12. The remaining circuit components are as before, and can be substituted and modified in the manner well known in the art, and as discussed above.

Figure 6:
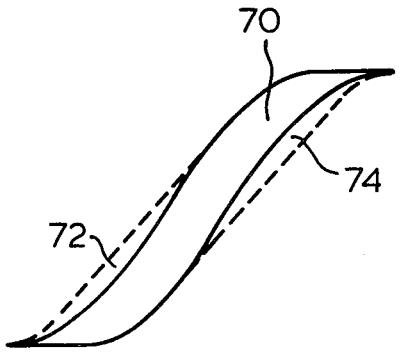
FIG. 6 is a representation of the volt-ampere vs. flux density characteristic of constant voltage transformers used in this invention.

Referring now to FIG. 6, there is shown in solid line a typical volt-ampere vs. flux density characteristic of steel such as that used in any constant voltage transformer 12 according to this invention, where the characteristic is indicated at 70. Two portions of the characteristic 72 and 74 are shown extending beyond the general characteristic 70, and are outlined in dashed lines. What the portion 72 and 74 represent — and, therefore, what the entire characteristic including portion 72 and 74 represents — is a more apparent linearization of the volt-ampere vs. flux density characteristic of the combined core and air gap of any of the constant voltage transformers 12 than that of, say, a similarly weighted and constructed saturating transformer. The latter characteristic would be substantially the more ordinary characteristic 70 shown in FIG. 6. Thus, the provision of an air gap in any of the constant voltage transformers 12 — whether they are autotransformers or isolating transformers — where the transformers have an iron core in any event, permits considerably harder driving of the core of the transformer with still substantially linear operation much closer to the otherwise saturating point of a similar transformer not having an air gap. It is a general condition of ferroresonant voltage regulating circuits that the transformer must be driven quite hard in order to provide the advantages of the ferroresonant voltage regulating circuit spoken of above; and the present invention therefore provides considerably greater linearization of the operation of the ferroresonant regulating circuit by establishing the operating limits of the air gap core as being extended substantially to the saturating limits of the core material. Non-saturating, substantially linear operation of the transformer over substantially the whole of its operating characteristic, even when driven hard, is thereby achieved.

Figure 7:
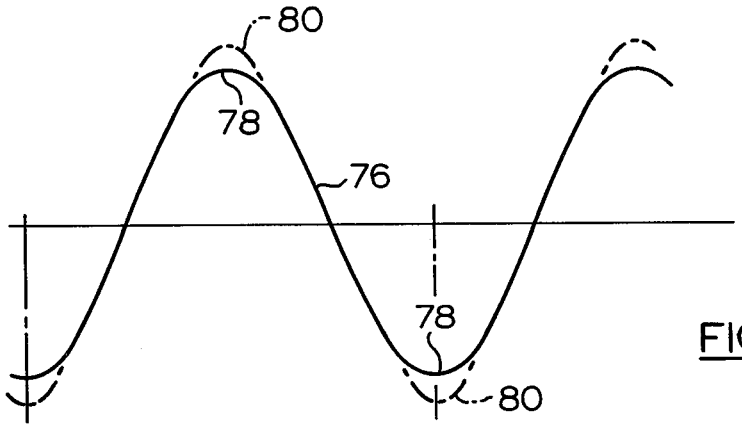
FIG. 7 is a representation of an improved output voltage waveform achieved by any of the circuits of the present invention.

The consequence of the provision of the non-saturating transformers according to the present invention is shown in FIG. 7, where a typical output voltage waveform 76 is shown. It will be noted, however, that the portions 78 of the waveform 76 are apparently clipped — or, indeed, they may be indented — especially at very high load conditions. The extension of the operating limits of the constant voltage transformers — where the iron core of the transformer has an air gap — substantially to the saturating limits of the material of the iron core permits a waveform including those portions 80 shown in dashed lines in FIG. 7, even at rated load conditions. The obvious consequence is, therefore, that the improved output waveform including portions 80 is more sinusoidal than previously, and therefore has a lower harmonic content. This consequence is particularly desirable where the load on the ferroresonant voltage regulating circuit is voltage and/or input waveform sensitive, such as certain telecommunications and computer devices.

Figure 8:
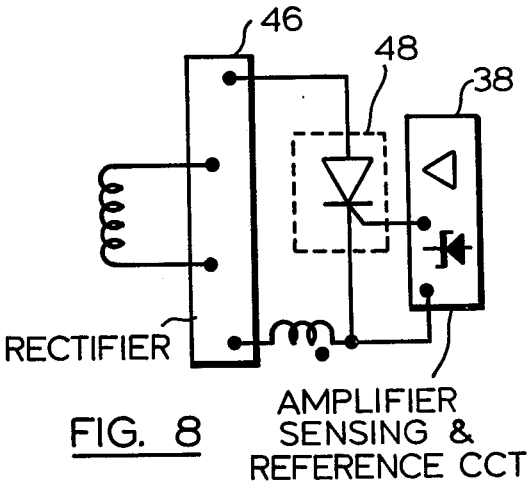
FIG. 8 is an alternative representation of a portion of the circuits of FIGS. 1, 3, 4 and 5.

Referring now to FIG. 8, the three-wire device shown generally by the numeral 48 in FIGS. 1, 3, 4 and 5 is shown, in FIG. 8, as being an SCR whose gate is connected by wire 50 to the amplifier, sensing and reference circuits indicated generally at 38.

FIG. 9, as noted above, shows an alternative embodiment of the constant voltage transformer 12 which, in this case, is specifically shown to be an isolating transformer having an input winding 18 and an output winding 20.

Figure 10:
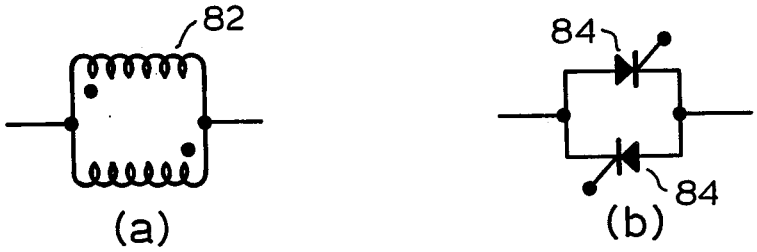
FIG. 10 shows several alternative embodiments of synchronous switches suitable for use in the present invention.
Figure 10:
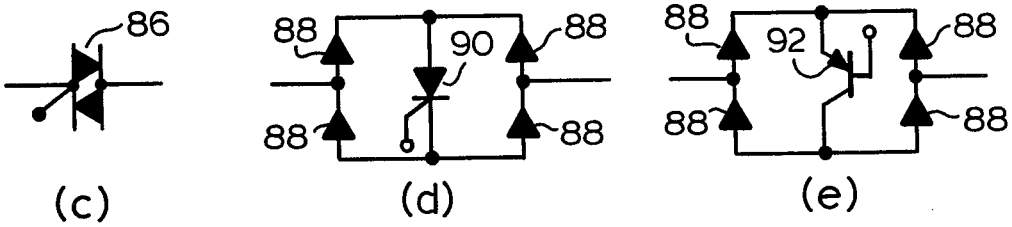

FIG. 10 shows several different embodiments of static switching means which might be substituted for the saturable reactor 82 of FIG. 10(*a*). The alternative, static switching means include a pair of anti-parallel connected SCR's 84, suitably filtered; a triac device 86; a diode bridge comprising diodes 88 shunted by an SCR 90; and a diode bridge shunted by a transistor 92. These alternative arrangements are illustrated in FIGS. 10(*b*), (*c*), (*d*) and (*e*) respectively.

Other modifications and substitutions in the circuitry of a ferroresonant voltage regulating circuit in accordance with this invention may be made, without departing from the spirit and scope of the following claims.

The embodiments of the invention in which an exclusive property or privilege is claimed are defined as follows:

1. In a ferroresonant voltage regulating circuit having an AC input voltage and a regulated AC output voltage; a constant voltage transformer with an input and an output side, an iron core having an air gap therein, and an overwind coil; a linear reactor in series with said AC input voltage, and a capacitor across said constant voltage transformer so that said linear reactor, capacitor and iron core transformer form a tuned ferroresonant circuit; synchronous switch means connected in shunt across at least a portion of a winding of said constant voltage transformer and having a control coil in series with a three-wire semiconductor device arranged with voltage sensing and reference means connected across the output of said voltage regulating circuit so that said three-wire semiconductive device and said control coil are conductive at no-load conditions of said voltage regulating circuit, and said synchronous switch is conductive when said control coil is conductive; where said constant voltage transformer is operated substantially linearly, the operating limits of the core and air gap of said constant voltage transformer being substantially the saturating limits of the core material thereof; said linear reactor in series with said AC input voltage being at least two taps, one of which is connected in said tuned ferroresonant circuit and the other of which is connected in series with a further linear reactor and said synchronous switch means, so that the connection of the series connection of said synchronous switch means and said further linear reactor to said transformer is through that portion of the first linear reactor between the two taps thereof which are connected to the series connection of said synchronous switch means and further linear reactor and said ferroresonant tuned circuit, respectively.

2. The ferroresonant voltage regulating circuit of claim 1 where synchronous switch means is a saturable reactor.

3. The ferroresonant voltage regulating circuit of claim 1 wherein said three-wire semiconductor device is a silicon controlled rectifier.

4. The ferroresonant voltage regulating circuit of claim 1 wherein said constant voltage transformer is an autotransformer.

5. The ferroresonant voltage regulating circuit of claim 1 where said constant voltage transformer is an isolating transformer having a primary winding and a secondary winding.

6. In a ferroresonant voltage regulating circuit having an AC input voltage and a regulated AC output voltage; a constant voltage transformer with an input and an output side, an iron core having an air gap therein, and an overwind coil; a linear reactor in series with said AC input voltage, and a capacitor across said constant voltage transformer so that said linear reactor, capacitor and iron core transformer form a tuned ferroresonant circuit; synchronous switch means connected in shunt across at least a portion of a winding of said constant voltage transformer and having a control coil in series with a three-wire semiconductor device arranged with voltage sensing and reference means connected across the output of said voltage regulating circuit so that said three-wire semiconductive device and said control coil are conductive at no-load conditions of said voltage regulating circuit, and said synchronous switch is conductive when said control coil is conductive; where said constant voltage transformer is operated substantially linearly, the operating limits of the core and air gap of said constant voltage transformer being substantially the saturating limits of the core material thereof;

said synchronous switch means connected in shunt across at least a portion of a winding of said constant voltage transformer being connected in series with a first winding of a further transformer having first and second windings and an iron core, the second winding of said further transformer being cross-connected across that portion of the constant voltage transformer across which the series connected synchronous switch means and first winding of a further transformer are connected, the series connection being shunt connected across said portion of a winding of said constant voltage transformer.

* * * * *